US012108810B2

(12) United States Patent
Polegato Moretti et al.

(10) Patent No.: US 12,108,810 B2
(45) Date of Patent: Oct. 8, 2024

(54) ARTICLE OF HOSIERY

(71) Applicant: GEOX S.p.A., Montebelluna (IT)

(72) Inventors: Mario Polegato Moretti, Crocetta del Montello (IT); Livio Poloni, Caerano di San Marco (IT)

(73) Assignee: GEOX S.p.A., Montebelluna (IT)

( * ) Notice: Subject to any disclaimer, the term of this patent is extended or adjusted under 35 U.S.C. 154(b) by 249 days.

(21) Appl. No.: 17/429,743

(22) PCT Filed: Mar. 4, 2020

(86) PCT No.: PCT/EP2020/055617

§ 371 (c)(1),
(2) Date: Aug. 10, 2021

(87) PCT Pub. No.: WO2020/182556

PCT Pub. Date: Sep. 17, 2020

(65) Prior Publication Data

US 2022/0117318 A1 Apr. 21, 2022

(30) Foreign Application Priority Data

Mar. 12, 2019 (IT) ..... 102019000003537

(51) Int. Cl.
*A41B 11/02* (2006.01)

(52) U.S. Cl.
CPC ..... *A41B 11/02* (2013.01); *A41B 2400/60* (2013.01)

(58) Field of Classification Search
CPC . D04B 1/26; D04B 1/265; A61F 13/08; A61F 13/085; A41B 11/00; A41B 11/02; A41B 11/005
See application file for complete search history.

(56) References Cited

U.S. PATENT DOCUMENTS

| | | | | |
|---|---|---|---|---|
| 5,708,985 | A | 1/1998 | Ogden | |
| 11,484,445 | B1 * | 11/2022 | Garner | A01N 59/16 |
| 2009/0095026 | A1 | 4/2009 | Araki et al. | |
| 2012/0284902 | A1 * | 11/2012 | Matsuo | D04B 1/108 2/239 |
| 2018/0168239 | A1 * | 6/2018 | Riaz | A41B 11/00 |
| 2019/0029331 | A1 * | 1/2019 | Field | A41B 11/003 |

OTHER PUBLICATIONS

International Search Report and Written Opinion issued on Jun. 3, 2020 in PCT/EP2020/055617 filed on Mar. 4, 2020.

* cited by examiner

*Primary Examiner* — Katherine M Moran
(74) *Attorney, Agent, or Firm* — Oblon, McClelland, Maier & Neustadt, L.L.P.

(57) ABSTRACT

An article of hosiery having a plurality of channels alternated with ridges, the channels have, at least in part, differentiated width.

12 Claims, 4 Drawing Sheets

ARTICLE OF HOSIERY

Figure 1:
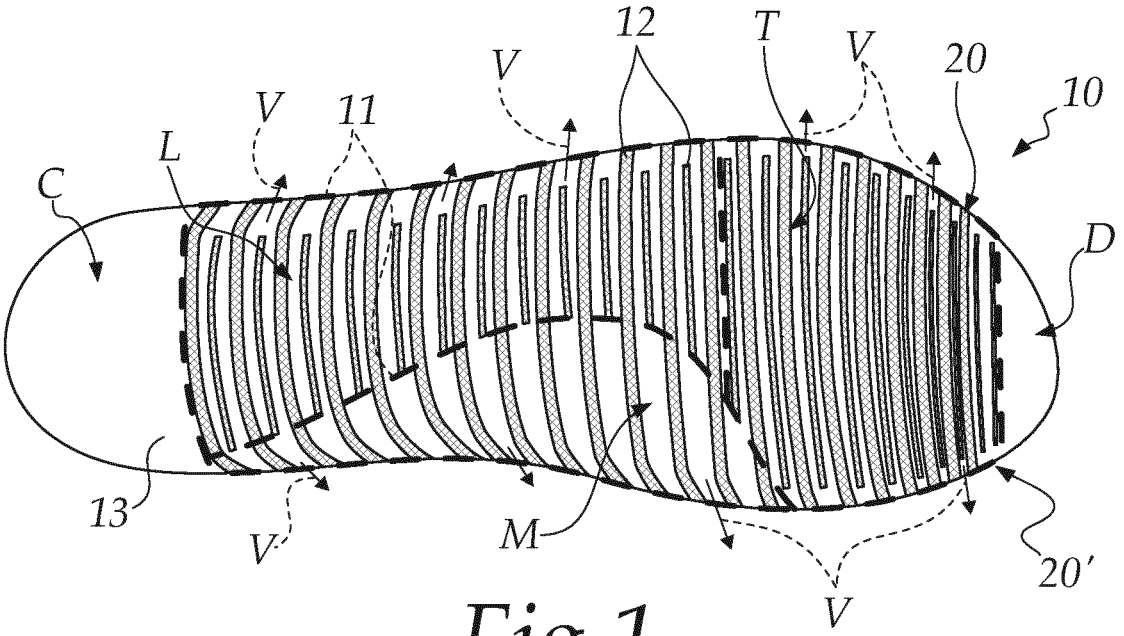

The present invention relates to an article of hosiery.

The invention is used in the clothing sector.

Nowadays articles of clothing are known and widespread which are adapted to cover and enclose limbs and extremities of the human body.

Among these are articles of hosiery which comprise, among others: stockings, socks, and pantyhose.

An article of hosiery, for example a stocking, generally covers the foot of the user up to the ankle, but can extend up to below the knee.

Usually, such article of hosiery is interposed between the foot and a shoe.

One of the purposes of the article of hosiery is to absorb the sweat generated by the sweat glands which are present, in great quantities, especially on the portion of the sole of the foot located proximate to the forefoot.

However the sweat absorption capacity of the fabric of which an article of hosiery is made is not unlimited.

For this reason, the article of hosiery becomes wet within a short time, causing a bothersome feeling of wetness and cold for the user, which generates discomfort.

Furthermore, when the fabric of which the article of hosiery is made becomes wet, the friction coefficient between the article of hosiery and the insole of the shoe increases and can exceed the friction coefficient between the article of hosiery and the skin of the foot of the user.

As a consequence, shear stresses can develop which act on the foot of the user, determining a relative movement of the foot with respect to the article of hosiery, instead of allowing the foot and the article of hosiery to move simultaneously.

Such phenomenon causes the formation of blisters and lacerations of the skin of the foot.

In addition, the evaporation of sweat can be considerably slowed when the foot is in a shoe, and in particular when the breathability of the shoe is poor or non-existent.

It is necessary, therefore, to seek solutions that favor the ventilation between the article of hosiery and the shoe, in order to allow the egress of sweat in the vapor phase and thus decrease the probability of its condensing inside the shoe, inevitably impregnating the article of hosiery.

Another object of the article of hosiery is to provide support, in particular to the sole of the foot, on which rests the weight of the human body, which also exerts a pressure on the article of hosiery due to its movement.

In fact, usually, the articles of clothing that the wearer uses interact with the human body, exerting, for example, a contact pressure at each point where there is contact between the articles and the human body.

Such contact pressure is due for example to the weight of the articles of clothing themselves and to the tension of the fabrics that they are made of.

The pressure of contact between the article of hosiery and the foot of the user, who wears it, assumes a different value according to the portion of the foot considered.

In fact it is known that, under static conditions, the foot usually has three points of support:

- the rear rest support, at the calcaneus,
- the antero-lateral support, at the head of the fifth metatarsal,
- the antero-medial support, at the head of the first metatarsal and the sesamoids.

These three points of support determine three different plantar arches:

- an anterior arch, formed by the five metatarsal heads,
- a lateral longitudinal arch, between the calcaneus and the head of the fifth metatarsal bone,
- a medial longitudinal arch, formed, proceeding in the direction from the back of the foot to the forefoot, by the calcaneus, by the ankle bone, by the scaphoid, by the first cuneiform and by the first metatarsal bone.

Then, during movement, placing the foot on the ground is divided into the three following phases:

- a first phase, in which the rear region of the heel makes contact with the ground, called "taligrade time",
- a second phase, of resting on the heels, front and rear, and on the lateral margin of the foot, called "plantigrade time",
- a third phase, of resting only on the forefoot, with progressive release of the resting on the metatarsal heads from the outside inward, called "digitigrade time".

In general, both when static and when in motion, in the median portion, the foot is mostly rested on the lateral surface of the sole, while the medial surface of the foot is only minimally involved.

It is therefore necessary that garments too are adapted to effectively and comfortably clothe the human body, for example not collapsing under the weight of the body or not sagging, for example, under their own weight, or, indeed, not excessively compressing some areas, for example restricted areas of the sole of the foot, causing feelings of pain or discomfort for the user.

These necessities are particularly important for articles of hosiery that, being predominantly in direct contact with the user's skin, have a considerable influence on the comfort perceived by the user.

In view of what is described above, there is a real need to create an article of hosiery that favors the elimination of warm air and of sweat in the vapor phase from inside the shoe to the outside, while seeking to contain the risk of condensation, while at the same time providing an adequate level of support to the foot.

It must be considered, however, that the needs specified above are present simultaneously, but to different extents, according to the different zones of the foot.

There is, therefore, also the need to provide articles of hosiery that succeed in meeting these needs in a diversified manner in the various zones of the foot.

U.S. Pat. No. 7,614,257 discloses the teachings for solving the problems of eliminating damp air originating from inside an article of hosiery, and of allowing the entry of air from outside, by providing an article of hosiery in which:

- the portion corresponding to the sole of the foot comprises first ridges, arranged according to a predefined direction,
- the portion corresponding to the instep of the foot comprises second ridges, similar to the first ridges, but aligned along the direction of longitudinal extension of the article of hosiery.

The first and second ridges substantially define channels inside which air and sweat in the vapor phase flow.

The air and the sweat in the vapor phase which come from the channels formed by the first ridges arrive in the channels formed by the second ridges and can thus exit from the shoe.

The air from outside enters the shoe and the article of hosiery by the same route as the sweat in the vapor phase, but in the opposite direction.

Such known art has a number of drawbacks.

In the disclosed article of hosiery, in fact, there are no ridges and channels, for example, in the plantar arch portion.

In this way, a disordered motion of sweat in the vapor phase can occur in such portion, with consequent condensation.

Furthermore, this patent document teaches to convey sweat in the vapor phase to the plantar arch portion which originates from, in particular, the portion located immediately behind the toes: this route is longer than the route that leads to the inner and outer sides of the foot, thus increasing the risk of condensation.

U.S. Pat. No. 5,319,807 discloses the teachings for providing an article of hosiery that comprises:

a multilayer panel, arranged at the instep of the foot, layers of thinner fabric than the panel, which are positioned on opposite sides of the multilayer panel, to form ventilation channels.

Substantially, the channels are defined by a difference in thickness of the fabric used in different zones.

Such known art also has a number of drawbacks, however.

In the article of hosiery described in this document, there are no channels at the sole of the foot, therefore in that portion ventilation is not improved in any way.

U.S. Pat. No. 5,708,985 discloses the teachings for providing an article of hosiery in which the portion in contact with the sole of the foot comprises ridges that extend in a transverse direction, with respect to the direction of extension of the article, and are longitudinally spaced apart.

These ridges are arranged at a mutual distance that is such as to allow the foot to sink into the space comprised between two successive ridges.

In this manner not only is the traction of the foot with the article of hosiery improved, but also the relative movement of the foot is reduced with respect to the article of hosiery inside a shoe.

However, in this way the ventilation inside the shoe is obstructed because the spaces between the ridges do not constitute channels that favor the elimination of warm air and sweat in the vapor phase.

U.S. Pat. No. 9,226,527 B2 discloses the teachings for providing an article of hosiery in which the surface in contact with the foot of the user comprises a plurality of ridges, which are at least partially arranged so as to form an angle or a curve with respect to a straight line that passes through the sole of the foot transversely.

These ridges extend upward from the sole of the foot toward the instep of the foot.

Such known art has the drawback that sweat in the vapor phase is not channeled toward the shortest route for getting from the sole of the foot to the instep of the foot, in this manner increasing the risk of condensation.

Finally, WO2011/143369 discloses the teachings for providing an article of hosiery that comprises:

protective elements, adapted to absorb shock at the toe and at the heel, shock-absorbing segments in the central portion of the foot, comprised between the forefoot and the back of the foot, which are oriented in the direction of walking so as to form channels that are adapted to guide the sweat far away from the sole of the foot.

However, this known art too has a number of drawbacks.

The channels are symmetrical with respect to the longitudinal axis of the foot, i.e. not differentiated between the inner foot and the outer foot, so that the same sock may be worn indifferently on the right foot or on the left foot, and furthermore the shock-absorbing segments are arranged in a closed path that delimits closed channels.

For these reasons the channels are not adapted to guide the sweat far away from the sole of the foot.

Also, these channels do not guide the sweat away from the sole of the foot along the shortest route, and therefore they do not contribute to reducing the risk of condensation.

The aim of the present invention is to provide an article of hosiery that is capable of improving the known art in one or more of the above mentioned aspects.

Within this aim, an object of the invention is to provide an article of hosiery that is capable of ensuring a better disposal of sweat both in the vapor phase and in the liquid phase compared to conventional articles of hosiery.

Another object of the invention is to provide an article of hosiery that enables a sufficient level of ventilation around the foot of the user, for an adequate exchange of heat and of water vapor between the inner microclimate of the shoe and the outside, even if the outer material of the shoe is not breathable.

A further object of the invention is to provide an article of hosiery that, by allowing the natural temperature control of the foot of the user, makes it possible to keep it dry for longer with respect to conventional articles of hosiery, with the result that it is more comfortable.

Another object of the invention is to provide an article of hosiery that is capable of ensuring an adequate level of support for the different zones of the foot of the user.

A further object of the present invention is to overcome the drawbacks of the known art in an alternative manner to any existing solutions.

Another object of the invention is to provide an article of hosiery that is highly reliable, easy to implement and of low cost.

This aim and these and other objects which will become better apparent hereinafter are achieved by an article of hosiery, of the type comprising a plurality of channels alternated with ridges, characterized in that said channels have, at least in part, differentiated width.

Figure 2:
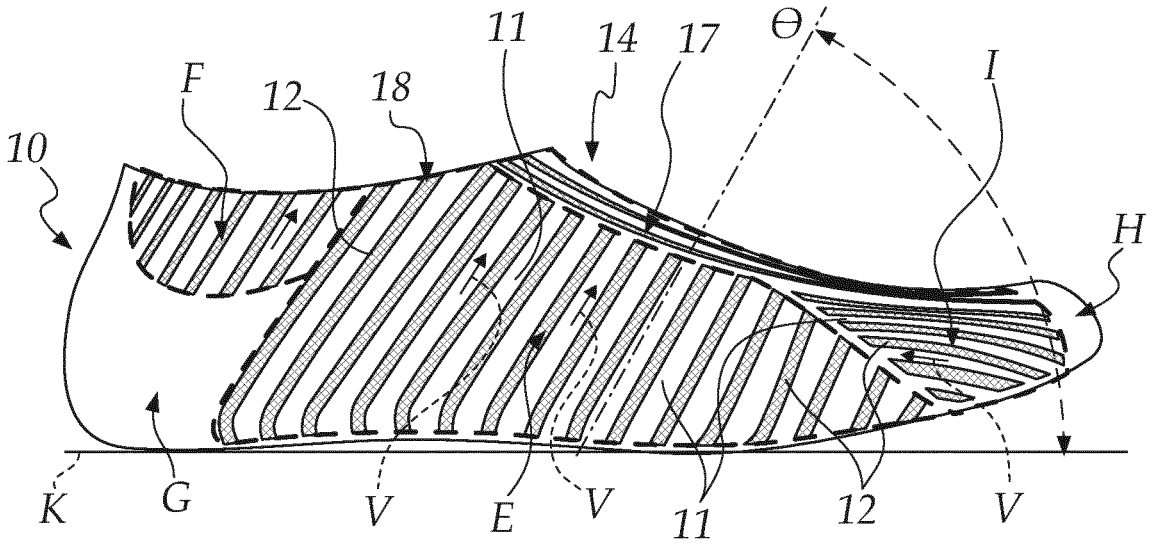
Figure 3:
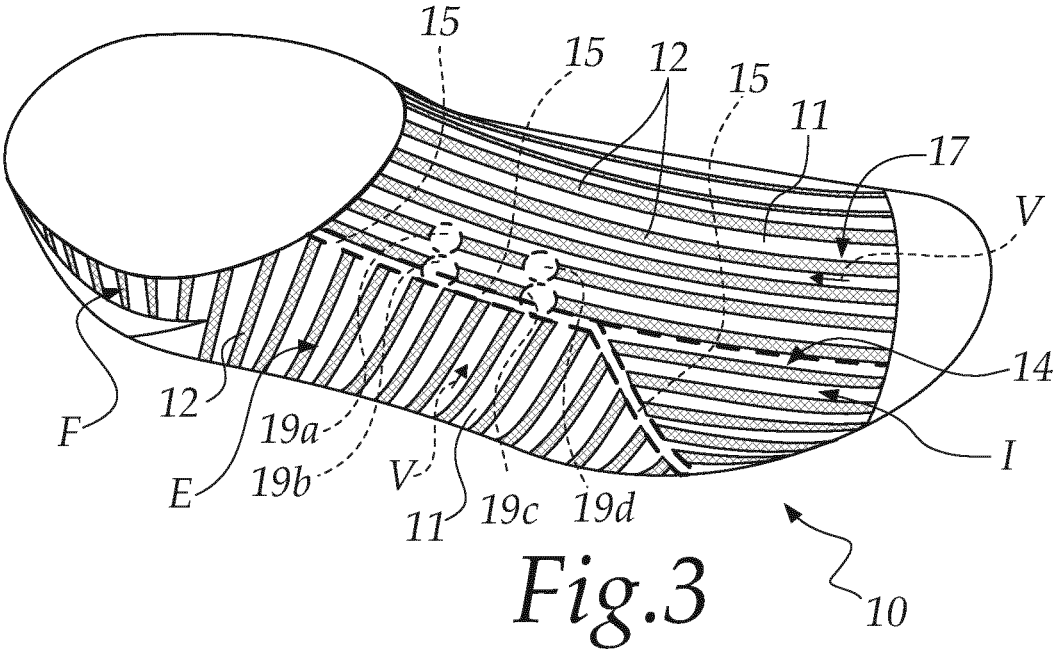
Figure 4:
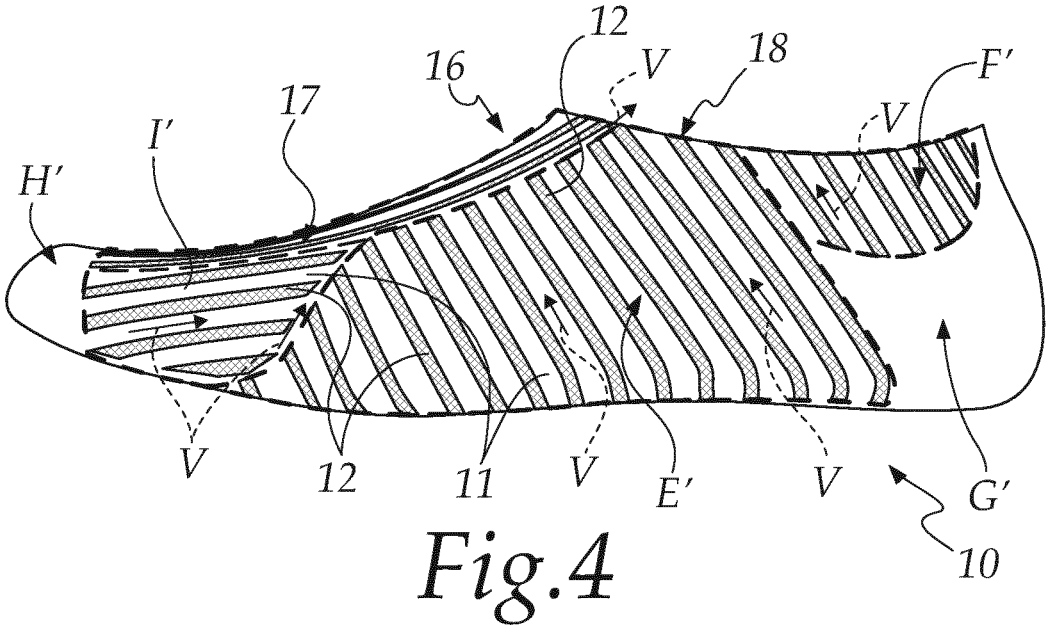
Figure 5:
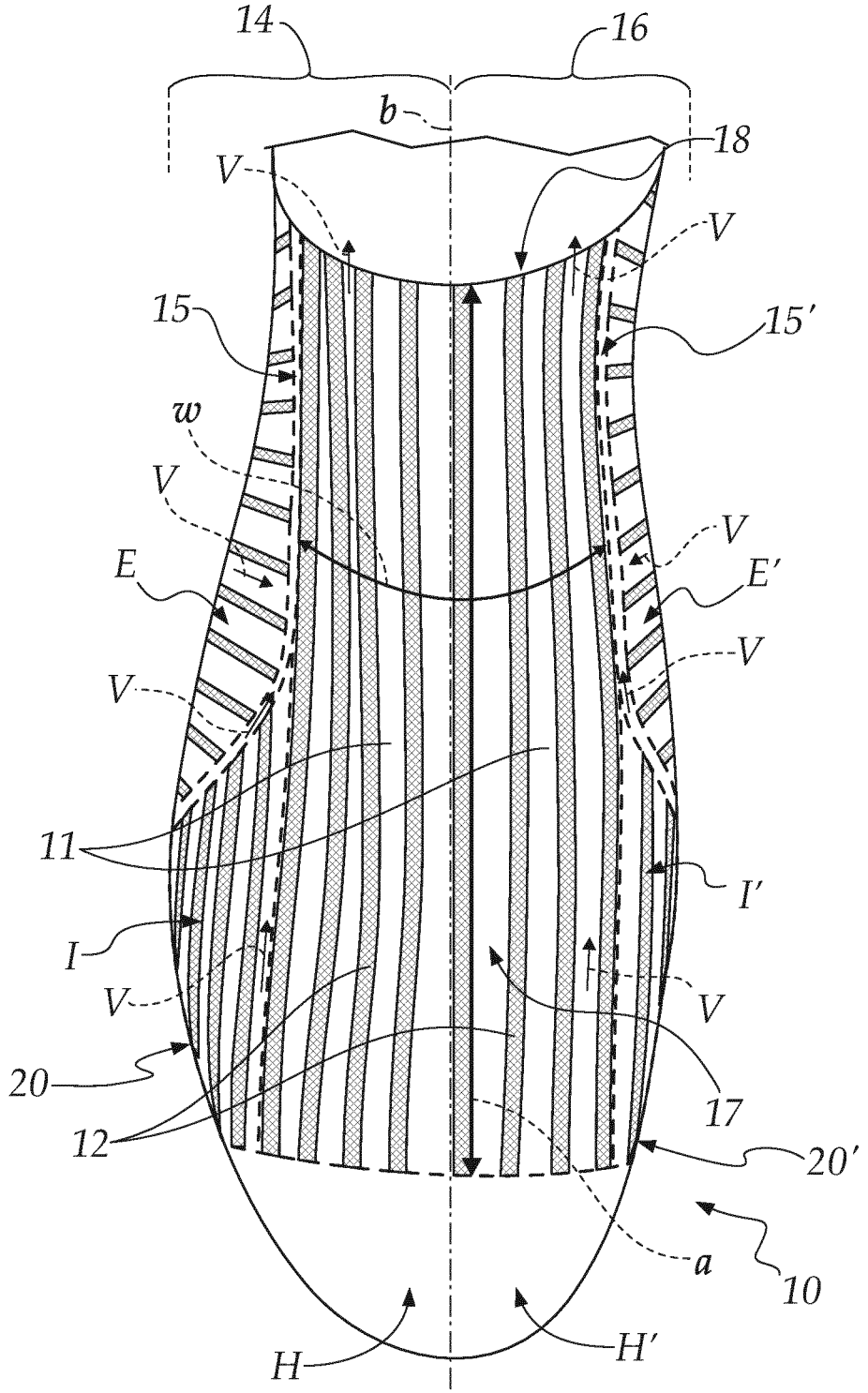
Figure 6:
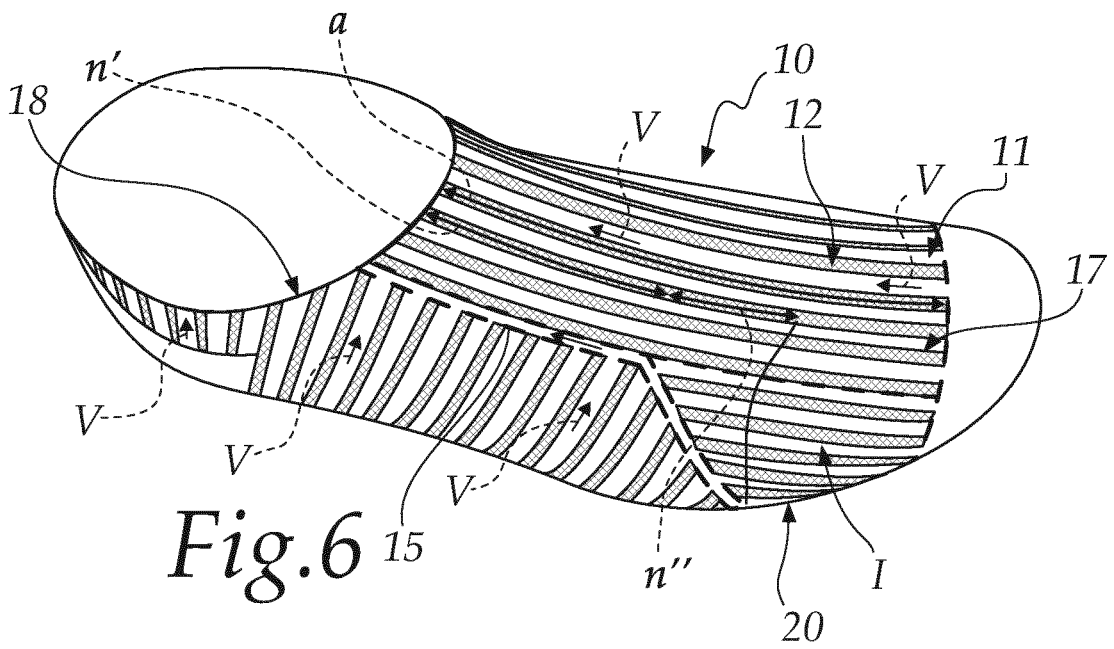
Figure 7:
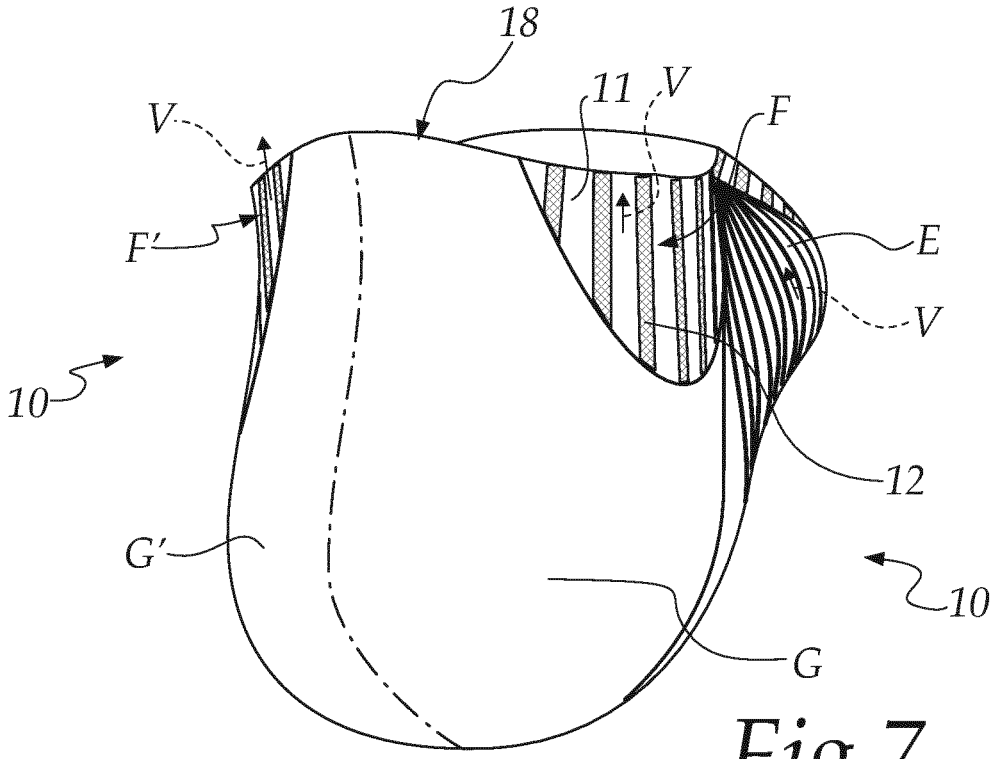

Further characteristics and advantages of the invention will become better apparent from the detailed description that follows of a preferred, but not exclusive, embodiment of the article of hosiery according to the invention, which is illustrated for the purposes of non-limiting example in the accompanying drawings wherein:

FIG. 1 is a view of the sole of an article of hosiery according to the invention;

FIG. 2 is a first side view of an article of hosiery according to the invention, FIG. 3 is a perspective view of an article of hosiery according to the invention, FIG. 4 is a second side view of an article of hosiery according to the invention, FIG. 5 is a view from above of an article of hosiery according to the invention, FIG. 6 is a different perspective view of an article of hosiery according to the invention, FIG. 7 is another perspective view of an article of hosiery according to the invention.

With reference to the figures, an article of hosiery according to the invention is generally designated by the reference numeral 10.

The article of hosiery 10 comprises preferential passages for air and sweat in the vapor phase.

The term "preferential" in the present description means "tends to be preferred" by sweat in the vapor phase which, when it encounters a material that has a portion with passages and a portion without, is attracted by the passages and tends to "prefer" them.

As a consequence, sweat in the vapor phase tends to prefer the portion that contains the passages over the portion that does not.

Such preferential passages are defined by channels 11, for the passage of sweat in the vapor phase.

Such channels 11 are determined by the presence of ridges 12, with which they are alternated.

The article of hosiery 10 comprises a first zone 13, substantially corresponding to the surface of the sole of the foot, and is divided into five portions:

- a first portion C, which substantially corresponds to the surface of the calcaneus,
- a second portion L, which substantially corresponds to the lateral surface of the sole,
- a third portion M, which substantially corresponds to the medial surface of the sole,
- a fourth portion T, which substantially corresponds to the surface of the metatarsal heads,
- a fifth portion D, which substantially corresponds to the distal surface.

The second portion L, of the first zone 13, requires a considerable support.

For this reason such second portion L comprises ridges 12 which follow the projection of the lateral longitudinal arch on the flat extension of the sole of the foot, as shown in FIG. 1.

In this manner the foot rests on a surface that follows the shape structure of the foot itself.

Conversely, the third portion M, of the first zone 13, requires less support than the second portion L, of the first zone 13.

The third portion M, of the first zone 13, is therefore provided with the ridges 12 at a greater mutual distance, with respect to the mutual distance between the ridges 12 of the second portion L, of the first zone 13.

In this manner, in the third portion M, of the first zone 13, there are wider channels 11 which favor a greater level of ventilation than the second portion L, of the first zone 13, in which, by contrast, the predominant necessity is to give adequate support to the foot.

The channels 11 alternated with the ridges 12 on the third portion M, of the first zone 13, have an extension preferably parallel to the transverse direction of the foot which is substantially perpendicular to the longitudinal direction of the foot.

The expression "longitudinal direction of the foot" in the present description means the direction of the axis that joins the forefoot to the back of the foot, known as the "Brannock axis", i.e. the axis that cuts the foot in half in the forefoot-back of the foot direction.

Thus the sweat, in the vapor phase, follows the shortest route that leads to the sides of the foot and from here it rises toward the ankle by the stack effect and then it exits to the outside environment.

The expression "stack effect" means the physical phenomenon whereby warm air moves upward from below.

The fourth portion T, of the first zone 13, is also involved in supporting the foot and requires a support similar to that of the second portion L, of the first zone 13.

The fourth portion T and the second portion L, of the first zone 13, have substantially the same arrangement of ridges 12 and channels 11.

In the fourth portion T and in the second portion L, of the first zone 13, the channels 11 alternated with the ridges 12 have an extension which is substantially parallel to the transverse direction of the foot.

Considering that:

- the weight of the body, both when static and when in motion, bears mainly on the calcaneus, which is the most massive bone of the tarsus,
- the surface of the sole of the foot at the calcaneus has almost no sweat glands,
- in the first portion C, of the first zone 13, the need for support for the foot is more important than the need for an adequate level of ventilation.

For these reasons, the article of hosiery 10 is substantially free from ridges and channels in the first portion C, of the first zone 13.

Generally it is possible to schematize a foot as a static rear triangle, and as a dynamic front triangle.

This dynamic front triangle extends on the portion of the foot that is most affected by the propulsion phase, in which an effective support is necessary in order to ensure an equally effective propulsion.

Therefore in the front triangle the need for support of the foot is predominant.

The front triangle is arranged substantially at the fifth portion D, of the first zone 13, which, as shown in FIG. 1, has substantially no ridges and channels, like the first portion C, of the first zone 13.

Where the need for support is more important, the fabric that makes up the article of hosiery 10 has a more substantial structure, i.e. it has a greater fabric density.

Such greater fabric density is obtainable, for example, by placing the ridges 12, which define the channels 11, at a smaller mutual distance.

Therefore, in order to obtain a greater texture and fabric density, and increase the support, the ridges 12, which define the channels 11, are arranged at a smaller mutual distance, with respect to the distance between the ridges 12 in the portions where the need for ventilation is more important than the need for support.

In the first and fifth portions C and D, of the first zone 13, which have substantially no channels, the fabric is advantageously made more substantial by virtue of the use of thicker yarns and/or of a tighter weave of yarns.

The second and fourth portions L and T, of the first zone 13, are portions with high fabric density.

The expression "high fabric density" means that the mutual distance between the ridges 12 is smaller than the mutual distance between the ridges 12 in zones with low fabric density.

In these two portions, second L and fourth T, of the first zone 13:

- the ridges 12 have a width preferably comprised between 1 mm and 7 mm,
- the channels 11 have a width preferably comprised between 1 mm and 3 mm.

The third portion M, of the first zone 13, is a portion with low fabric density.

The expression "low fabric density" means that the mutual distance between the ridges 12 is greater than the mutual distance between the ridges 12 in zones with high fabric density. This results in a fabric with lower density.

In this third portion M, of the first zone 13:

- the ridges 12 have a width preferably comprised between 2 mm and 5 mm,
- the channels 11 have a width preferably comprised between 3 mm and 6 mm.

The article of hosiery 10 also comprises a second zone 14, shown in FIG. 2, which wraps around the outer instep of the foot.

The second zone 14 in turn comprises:

a first portion E, external, a second portion F, lateral malleolar, which is arranged substantially at the lateral malleolus, a third portion G, posterior, which constitutes substantially the projection, perpendicular to the foot resting plane K, of the first portion C, of the first zone 13, on the second zone 14, a fourth portion H, anterior, which constitutes substantially the projection, perpendicular to the foot resting plane K, of the fifth portion D, of the first zone 13, on the second zone 14, a fifth portion I, intermediate between the fourth portion H and the first portion E.

The first and second portions E and F, of the second zone 14, have channels 11, alternated with ridges 12, which extend upward, in the conditions of use of the article 10, according to an inclination θ comprised between 50° and 80°, preferably between 60° and 70°, measured with respect to the foot resting plane K.

From experimental tests, such an inclination θ has been shown to be effective for directing sweat in the vapor phase toward the upper portion of the article of hosiery 10 in the configuration for use.

In fact conventional articles of hosiery have channels that extend from the sole of the foot toward the ankle, therefore, predominantly with an angle of inclination that exceeds 90°.

In this manner, however, these channels concentrate all the sweat in the vapor phase toward a restricted area in a neighborhood of the ankle.

This determines an overload of sweat in the vapor phase in that neighborhood, which accumulates, thus increasing the risk of condensation.

Furthermore, in order to run the channels from the plantar portion of the foot to the ankle it is necessary to narrow those channels and/or make multiple channels converge into a single channel system in order to adapt to the dimensions of the ankle, which are smaller than those of the sole.

This results in a complicated implementation of the article of hosiery and implies that zones are to be provided with very different consistencies of fabric in the second zone, which generate discomfort for the user.

In order to simplify the implementation, some conventional products limit the presence of channels to some restricted portions while omitting others, which however reduces the overall effectiveness of the article.

The article of hosiery 10, by contrast, is capable not only of distributing sweat in the vapor phase in a neighborhood of the instep of the foot, but also of directing it toward a manifold 15, shown in FIG. 3.

In fact the article of hosiery 10 is provided with channels 11 in the first portion E, of the second zone 14, which converge in the manifold 15, routing sweat in the vapor phase thereto.

The manifold 15 extends upward, in the configuration for use, i.e. toward the instep of the foot, and defines the border:

with a first section thereof, between the first portion E and the fifth portion I, of the second zone 14, with a second section thereof, between the first portion E, of the second zone 14, and a part 17, described below.

In order to increase the channels 11, in which to distribute the sweat in the vapor phase, the ridges 12 contained in the part 17 and closest to the manifold 15 can have interruptions, for example the ones shown with the reference numerals 19*a*, 19*b*, 19*c* and 19*d*.

The interruptions 19*a*-19*d* favor communication between nearby channels 11, and therefore the diffusion of sweat in the vapor phase.

The second portion F, of the second zone 14, favors the transit of sweat in the vapor phase toward the ankle and in particular the sweat produced by the sweat glands that are arranged below the malleolus.

In fact, proximate to the malleolus, the article of hosiery 10 adheres better to the foot of the user owing to the protrusion of the malleolus itself, and this generates a decrease in the space between the article of hosiery and the foot, obstructing the rising movement of the sweat in the vapor phase.

Therefore, in this portion sweat in the vapor phase requires passages that favor its rising movement toward the ankle.

The first and second portions E and F, of the second zone 14, are zones with low fabric density and comprise:

ridges 12 which have a width preferably comprised between 2 mm and 5 mm, channels 11 which have a breadth comprised between 3 mm and 6 mm.

The article of hosiery 10 also comprises a third zone 16, shown in FIG. 4.

The third zone 16 wraps around the inner instep of the foot and comprises:

a first portion E', internal, a second portion F', medial malleolar, which is arranged substantially at the medial malleolus, a third portion G', posterior, which constitutes substantially the projection, perpendicular to the foot resting plane K, of the first portion C, of the first zone 13, on the third zone 16, a fourth portion H', anterior, which constitutes substantially the projection, perpendicular to the foot resting plane K, of the fifth portion D, of the first zone 13, on the third zone 16, a fifth portion I', intermediate between the fourth portion H and the first portion E'.

Such portions, from the first E' to the fifth I', of the third zone 16, are similar to the respective portions, from the first E to the fifth I, of the second zone 14, described previously.

As in the second zone 14, also in the third zone 16 there is a manifold 15', similar to the manifold 15.

The channels 11 of the first portion E' of the third zone 16 converge in the manifold 15', routing sweat in the vapor phase thereto.

The article of hosiery 10 also comprises the part 17, shown in FIGS. 2 to 6.

This part 17 extends at the back of the foot, longitudinally, from the fifth portions H and H', respectively of the second zone 14 and of the third zone 16, up to an upper edge 18.

The first portions E and E', second portions F and F', respectively of the second zone 14 and of the third zone 16, and the part 17 are delimited, in an upper region, by such edge 18.

This upper edge 18 is substantially a curvilinear profile which, in the embodiment shown in the figures, is arranged below the circumference of the ankle.

The expression "circumference of the ankle" in the present description means the minimum circumference, parallel to the foot resting plane, immediately above the malleoli.

Such part 17 is delimited laterally:

for a first section, by the manifolds 15 and 15', for a second section, by the fourth portions H and H' and by the fifth portions I and I', respectively of the second zone 14 and of the third zone 16.

The fifth portions I and I', respectively of the second zone 14 and of the third zone 16, are delimited by the part 17, by the respective manifold 15 or 15', by the respective fourth portion H or H' and, below, by the fourth portion T, of the first zone 13.

The part 17 extends for a width w comprised between 15% and 30%, preferably between 20% and 25%, of the measurement of the instep of the foot.

The measurement of the instep of the foot is the smallest circumference beyond the protrusion of the median cuneiform.

The part 17 of the article 10 extends for a length comprised between 40% and 60% of the length of the foot.

The expression "length of the foot" in the present description means the distance measured along the Brannock axis, indicated with b in FIG. 5, from the rear part of the heel up to the tip of the longest toe.

Considering FIGS. 5 and 6, the manifolds 15 and 15' have an extension from the upper edge 18:

for a first section n', equal to approximately half of the length a of the part 17, predominantly in the direction of the Brannock axis b, for a second section n", equal to approximately 0.15-0.35 times the length a, of the part 17, which follows an inclined orientation up to the respective lateral edge 20, 20' of the fourth portion T, of the first zone 13.

The manifolds 15, 15' have a width comprised between 1 mm and 6 mm.

The interruptions 19*a*-19*d*, advantageously, are arranged preferably along the first section n'.

The interruptions 19*a*-19*d* have a breadth preferably comprised between 1 and 5 mm, more preferably between 2 and 4 mm.

The dimensions of the fifth portions I and I', of the second zone 14 and of the third zone 16, are determined by the dimensions of the part 17 and by the geometry of the manifolds 15 and 15'.

The part 17 and the fifth portions I and I', of the second zone 14 and of the third zone 16, comprise channels 11 alternated with ridges 12 which have an extension predominantly in the direction of the Brannock axis b.

In the part 17 the channels 11 and the ridges 12 have an extension from the fifth portions H and H', of the second zone 14 and of the third zone 16, up to the upper edge 18.

In this manner the movement of sweat in the vapor phase toward the ankle is favored, from which it then exits toward the outside environment.

In the fifth portions I and I', of the second zone 14 and of the third zone 16, the channels 11 and the ridges 12 have an extension, respectively, from the fourth portions H and H', of the second zone 14 and of the third zone 16, up to the manifolds 15 and 15'.

In practice the channels 11 of the fifth portions I and I' converge in the manifolds 15 and 15'.

This allows the sweat in the vapor phase that is channeled in the channels 11 to be guided toward the manifolds 15 and 15'.

The sweat in the vapor phase, rising due to the stack effect, is routed by the manifolds 15 and 15' toward the edge 18.

This makes it possible to keep a fabric structure comprising the article of hosiery 10 substantially uniform, reducing and/or eliminating the presence of constrictions of ridges and/or channel systems which could cause a feeling of discomfort in the user.

An article of hosiery is, in fact, an article of clothing that is adapted for direct contact with the user's skin, therefore the structure of the fabric that makes it up is immediately perceived by the user.

The part 17 and the fifth portions I and I', of the second zone 14 and of the third zone 16, are zones with low fabric density:

the ridges 12 have a width preferably comprised between 2 mm and 5 mm, the channels have a breadth comprised between 3 mm and 6 mm.

FIG. 7 is a perspective view from the rear of the article 10.

In this embodiment the article of hosiery 10 is a sock which extends up to the ankle, however the invention is not limited to this type, but can be applied in an equivalent manner, for example, in the form of a stocking that comes up to the knee, where the upper edge 18 is arranged above the circumference of the ankle.

The article of hosiery 10 is preferably made of fabric that comprises natural and/or synthetic yarns.

Advantageously hydrophobic yarns can be used on the surfaces in contact with the body of the user and hydrophilic yarns can be used on the surfaces directed toward the outside environment, so as to also facilitate the removal of sweat in the liquid phase from the body of the user.

The fabric can conveniently comprise zones with a more porous structure, obtained, for example with knitted stitches of the fabric set at a greater mutual distance, so as to favor the passage of sweat in the vapor phase through the fabric.

In particular, the fabric can be made, for example, of cotton, wool, polyester, polyamide and the like, as well as combinations of these.

The fabric can be constituted by one or more layers: for example a first layer, advantageously hydrophobic, at the channels 11, to which is added a second layer, advantageously hydrophilic, at the ridges 12.

Such configuration is advantageous because the sweat in the liquid phase is not trapped by the first layer, which is the layer in contact with the foot of the user, and is instead removed from the foot because it is wicked away by the second layer.

The thickness of the fabric at the ridges 12 is from 0.3 mm to 3 mm greater than the thickness at the channels 11.

The ridges 12 have, therefore, a thickness comprised between 0.3 mm and 3 mm.

In the figures, the arrows indicated with V show the route of the sweat in the vapor phase inside the channels 11.

In practice it has been found that the invention fully achieves the intended aim and objects by providing an article of hosiery that is capable of ensuring an adequate level of support for the different zones of the foot of the user.

With the invention an article of hosiery has been devised that, by allowing the natural temperature control of the foot of the user, makes it possible to keep it dry for longer with respect to conventional articles of hosiery, with the result that it is more comfortable.

It should be noted that, with the invention, an article of hosiery has been provided that enables a sufficient level of ventilation around the foot of the user, for an adequate exchange of heat and of water vapor between the inner microclimate of the shoe and the outside, even if the outer material of the shoe is not breathable.

Finally, with the invention an article of hosiery has been provided that is capable of ensuring a better disposal of sweat both in the vapor phase and in the liquid phase compared to conventional articles of hosiery.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 1020190000003537 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. An article of hosiery, comprising:

a plurality of channels with a ridge therebetween, wherein said channels have, at least in part, differentiated width;

one or more portions with high fabric density;

portions and/or a part with different fabric density; and at least one manifold, wherein in said one or more portions with high fabric density, the channels have a breadth comprised between 1 mm and 3 mm, and the ridges have a width comprised between 1 mm and 7 mm, and wherein said at least one manifold has an extension from an upper edge of the article. the manifold:

for a first section, is equal to approximately half of a length of the extension, configured to be oriented predominantly in the direction of a Brannock axis, for a second section, is equal to approximately 0.15-0.35 times the length of the extension, following an inclined orientation up to a lateral edge of a fourth portion of a first zone, said first zone configured to correspond substantially to the surface of a sole of a foot, said fourth portion of said first zone configured to correspond substantially to the surface of the metatarsal heads of the foot of the user.

2. The article according to claim 1, further comprising one or more portions and/or a part with low fabric density, wherein the portions and/or part with low fabric density include channels and ridges.

3. The article according to claim 2, wherein in said one or more portions and/or part with low fabric density:

said channels have a breadth comprised between 3 mm and 6 mm, said ridges have a width comprised between 2 mm and 5 mm.

4. The article according to claim 2, wherein in at least one of said portions with low fabric density, said channels and said ridges have an extension upward having an inclination angle comprised between 50° and 80°, measured with respect to a resting plane of the article.

5. The article according to claim 2, wherein said one or more portions and/or part with low fabric density is configured to be positioned at an instep of a foot.

6. The article according to claim 1, wherein it comprises at least one portion which is substantially free from said channels and said ridges.

7. The article according to claim 1, wherein at least one of said portions and/or said part comprises said channels alternated with said ridges which have an extension configured to be oriented predominantly in the direction of a Brannock axis.

8. The article according to claim 1, wherein in at least one of said portions, said channels alternated with said ridges have an extension configured to be substantially parallel to the transverse direction of a foot.

9. The article according to claim 1, wherein at least one of said channels converge in said at least one manifold.

10. The article according to claim 1, wherein said at least one manifold has at least one interruption.

11. An article of hosiery, comprising:

a plurality of channels alternated with ridges, wherein said channels have, at least in part, differentiated width;

at least one manifold;

one or more portions and/or a part with low fabric density; and portions and/or a part with different fabric density, wherein in at least one of the portions with low fabric density, said channels and said ridges have an extension upward having an inclination comprised between 50° and 80°, measured with respect to a resting plane of the article, and wherein said at least one manifold has an extension from an upper edge of the article, the manifold:

for a first section, is equal to approximately half of a length of the extension, configured to be oriented predominantly in the direction of a Brannock axis, for a second section, is equal to approximately 0.15-0.35 times the length of the extension, following an inclined orientation up to a lateral edge of a fourth portion of a first zone, said first zone configured to correspond substantially to the surface of a sole of a foot, said fourth portion of said first zone configured to correspond substantially to the surface of the metatarsal heads of the foot of the user.

12. An article of hosiery, comprising:

a plurality of channels alternated with ridges, wherein said channels have, at least in part, differentiated width;

at least one manifold;

one or more portions with high fabric density;

one or more portions and/or a part with low fabric density; and portions and/or a part with different fabric density, wherein in said one or more portions with high fabric density, the channels have a breadth comprised between 1 mm and 3 mm, and the ridges have a width comprised between 1 mm and 7 mm, wherein in at least one of the portions with low fabric density, said channels and said ridges have an extension upward having an inclination comprised between 50° and 80°, measured with respect to a resting plane of the article, and wherein said at least one manifold has an extension from an upper edge of the article, the manifold:

for a first section, is equal to approximately half of a length of the extension, configured to be oriented predominantly in the direction of a Brannock axis, for a second section, is equal to approximately 0.15-0.35 times the length of the extension, following an inclined orientation up to a lateral edge of a fourth portion of a first zone, said first zone configured to correspond substantially to the surface of a sole of a foot, said fourth portion of said first zone configured to correspond substantially to the surface of the metatarsal heads of the foot of the user.

* * * * *